US008152153B2

(12) United States Patent
Blanchard, Jr. et al.

(10) Patent No.: US 8,152,153 B2
(45) Date of Patent: Apr. 10, 2012

(54) WEB HANDLING METHOD AND APPARATUS

(75) Inventors: Raymond A. Blanchard, Jr., Dryden, NY (US); Donald A. Campbell, Binghamton, NY (US); Richard E. Roberts, Elmira, NY (US); Donald J. Ward, Sayre, PA (US)

(73) Assignee: Avery Dennison Corporation, Pasadena, CA (US)

( * ) Notice: Subject to any disclaimer, the term of this patent is extended or adjusted under 35 U.S.C. 154(b) by 1134 days.

(21) Appl. No.: 11/442,726

(22) Filed: May 30, 2006

(65) Prior Publication Data

US 2006/0214348 A1 Sep. 28, 2006

Related U.S. Application Data

(62) Division of application No. 10/703,932, filed on Nov. 7, 2003, now Pat. No. 7,213,807.

(51) Int. Cl.
*B65H 33/04* (2006.01)

(52) U.S. Cl. ..... 270/58.31; 270/58.32

(58) Field of Classification Search ..... 270/58.31, 270/58.32; 271/117, 119, 120, 131, 207, 271/264; 399/404; 414/789.5, 791.2
See application file for complete search history.

(56) References Cited

U.S. PATENT DOCUMENTS

| | | | | |
|---|---|---|---|---|
| 2,235,844 | A * | 3/1941 | Nelson | 271/114 |
| 3,964,741 | A | 6/1976 | Kroeker | |
| 4,067,568 | A * | 1/1978 | Irvine | 271/176 |
| 4,176,834 | A * | 12/1979 | Takahashi | 271/116 |
| 4,305,577 | A * | 12/1981 | Clay et al. | 271/119 |
| 4,440,514 | A * | 4/1984 | Keiter et al. | 400/208 |
| 4,442,774 | A | 4/1984 | Pou | |
| 4,501,224 | A | 2/1985 | Shibayama et al. | |
| 4,603,629 | A | 8/1986 | Pou | |
| 4,669,717 | A | 6/1987 | Yamashita et al. | |
| 4,723,773 | A * | 2/1988 | Westover et al. | 271/10.07 |
| 4,730,822 | A | 3/1988 | Wagner | |
| 4,949,608 | A | 8/1990 | Ward | |
| 5,407,081 | A | 4/1995 | Oshino et al. | |
| 6,056,288 | A | 5/2000 | Tsai et al. | |
| 6,095,517 | A | 8/2000 | Dinatale | |
| 6,227,531 | B1 | 5/2001 | Guerrero et al. | |
| 7,192,025 | B1 * | 3/2007 | Golicz et al. | 271/34 |

FOREIGN PATENT DOCUMENTS

JP 04333435 A * 11/1992

OTHER PUBLICATIONS

English Translation of JP 04333435; No representation of the accuracy or completeness of the translation is made.

* cited by examiner

*Primary Examiner* — Leslie A Nicholson, III
(74) *Attorney, Agent, or Firm* — Avery Dennison Corporation

(57) ABSTRACT

There is disclosed an improved stacker, method of stacking sheets such as tags, and a stack of sheets. The stacker and the stacking method produces a stack of sheets, wherein same-size sheets are stacked so that the endmost sheet or sheets in one batch are offset or staggered to provide batch separators in a stack of sheets. The stacker includes an improved sheet feed mechanism that enables sheets having different characteristics to be fed without disassembling any portion of the mechanism or the stacker.

9 Claims, 15 Drawing Sheets

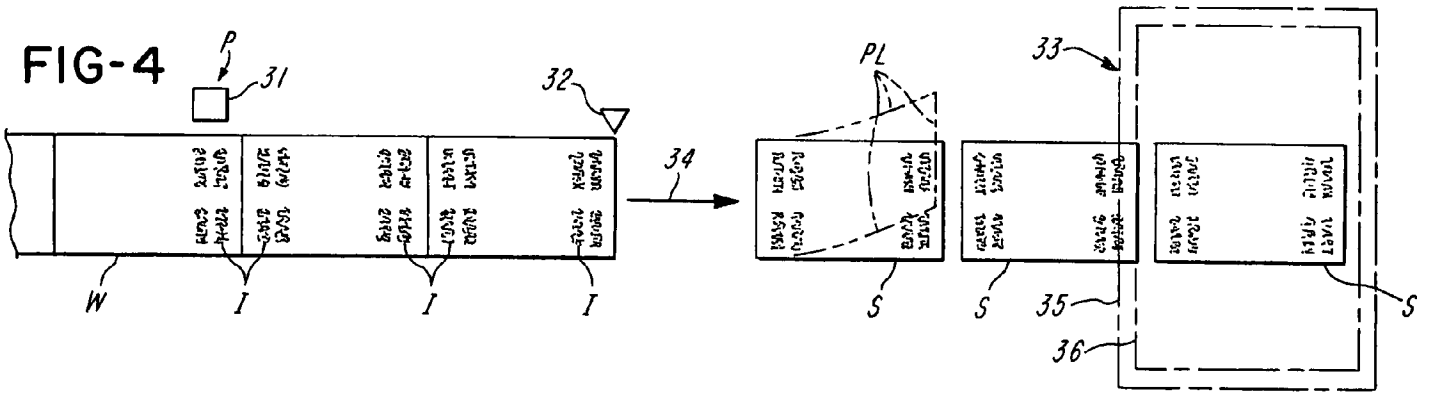
FIG-4
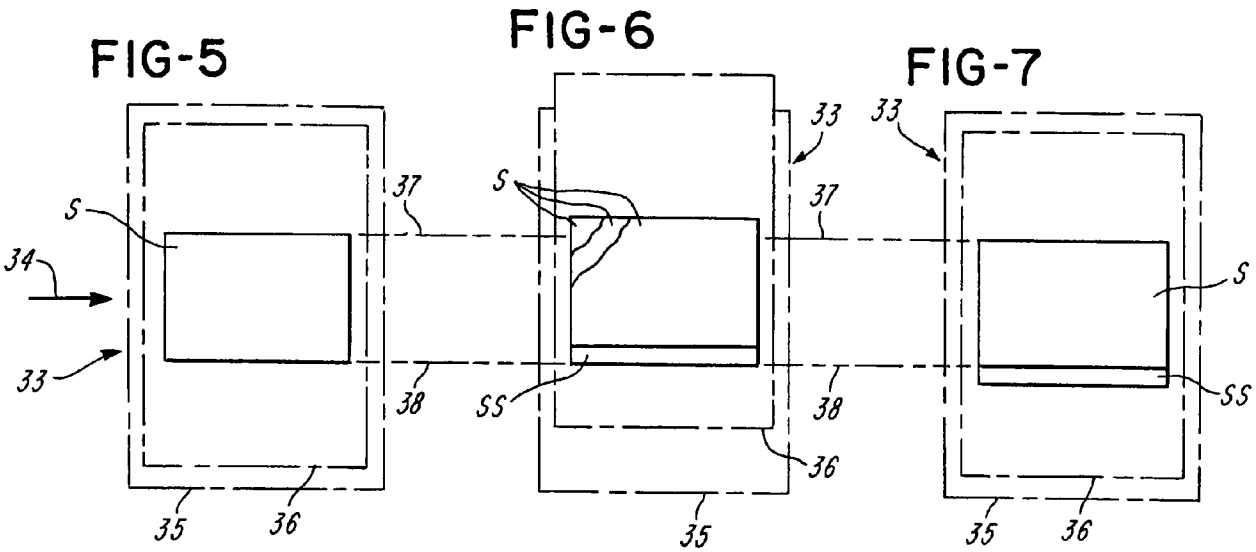
FIG-5
FIG-6
FIG-7

WEB HANDLING METHOD AND APPARATUS

CROSS-REFERENCE TO RELATED APPLICATION

This application is a division of application Ser. No. 10/703,932, filed Nov. 7, 2003 now U.S. Pat. No. 7,213,807.

FIELD OF THE INVENTION

This invention relates to a stacker for stacking sheets, method of stacking sheets and to a stack of sheets.

BACKGROUND OF THE INVENTION

The following prior art U.S. patents are made of record: U.S. Pat. Nos. 4,442,774; 4,501,224; 4,603,629 and 4,949,608.

SUMMARY OF THE INVENTION

This invention relates to an improved, user-friendly stacker for stacking batches of sheets in a stack wherein the batches are separated from each other by batch separators or sheets.

The invention also relates to improved methods of stacking batches of sheets in a stack wherein batches are separated from each other by batch separator or sheets.

The invention also relates to an improved stack of batches of sheets separated by batch separators also referred to as flags.

It is a feature of the invention to provide improved method and apparatus for stacking sheets in batches wherein the batches are separated by batch separators or separator sheets provided while sheets are accumulating in the stack. The sheets of each batch bear the same information, and adjacent batches have different information. It is preferred that all the sheets in the stack are the same size, in particularly, the separator sheets are the same size as the remainder of the sheets in the batches. In this way the separator sheet or sheets of one batch can bear the same information as the reminder of the sheets in the same batch. Therefore, there is no wasted sheet, as would be the case if the batch separator were a blank sheet or if the batch separator contained edge marking to identify the end of a batch. The batch separator or separator simply comprises one or more sheets that are the same as the other sheets in the same batch, but they are offset or staggered with respect to the remainder of sheets in that batch. In that the batch separators of the invention extend beyond the sides of the sheets, the stack can be readily identified and manually grasped to enable one entire batch to be readily removed from the remainder of the stack.

It is a feature of the invention to provide an improved stacker and stacking method wherein sheets are progressively accumulated in alignment in a stack in batches. When a batch is almost complete, the last sheet or the last several sheets are offset with respect to the accumulated sheets of that batch to provide a batch separator. The next batch of sheets is accumulated the same way, and again, the last sheet or sheets of the next batch are offset with respect to the remainder of sheets of that next batch, and so on.

It is preferred to create a stack with offset batch separators identifying the end of each batch by feeding sheets along a path and shifting all the aligned sheets previously accumulated in the stack as a unit. When the batch separator(s) have been added to the stack, the sheets previously accumulated including the added batch separator(s) are shifted as a unit so that as sheets of the next batch are fed along the path and accumulated. The sheets of that next batch will be aligned with the aligned sheets of the previously accumulated batch.

It is a feature of the invention to provide a stacker which includes a stationary base and a stacker carriage at an initial or home position. Printed sheets are feed longitudinally along a path onto the stacker carriage. The sheets accumulate in the stacker carriage. When the batch is nearly complete, that is one or several sheets still need to be added to the previously accumulated sheets to complete the batch, the stacker carriage is shifted laterally of the path to an advanced or flag position. As the accumulation of sheets continues, these sheets will be separator sheets. Because the stacker carriage has been shifted laterally, the separator sheets will be offset from the previously accumulated sheets in that batch in the stack. When that batch has been completed by the batch separator(s), the stacker carriage is again shifted, that is, returned to its initial or home position. As the next batch starts accumulating, these next sheets will be aligned with the sheets of the previous batch and offset with respect to the batch separator(s). Again, when this next batch is nearly complete the stacker carriage is shifted again to provide the offset batch separator(s), and so on.

It is a feature of the invention to provide an improved method of printing on a web, cutting the web into sheets, feeding the sheets along a path toward a stacker, ejecting a leader from the path, passing the sheets to a stacker, and stacking the sheets in batches with at least one endmost sheet in each batch offset from the other sheets in that batch to provide batch separation; and it is a feature of the invention to provide apparatus for carrying out the method.

It is also a feature of the invention to provide an improved sheet feeder that is useful in feeding sheets having different characteristics, without the need to disassemble part or all of the sheet feeder. In accordance with a specific embodiment, different feed members for feeding sheets having different characteristics are mounted so that the feed members can be selectively moved into a sheet feeding position.

BRIEF DESCRIPTION OF THE DIAGRAMMATIC DRAWINGS

FIG. 4 is a top plan view showing the feed path and progression of the web of sheets as they are printed, as sheets are cut from the web, and as the sheets are fed into the stacker;

FIGS. 5, 6 and 7 are aligned figures illustrating the feed path and the different positions of the stacker carriage and the sheets in the stack;

Figure 19A:
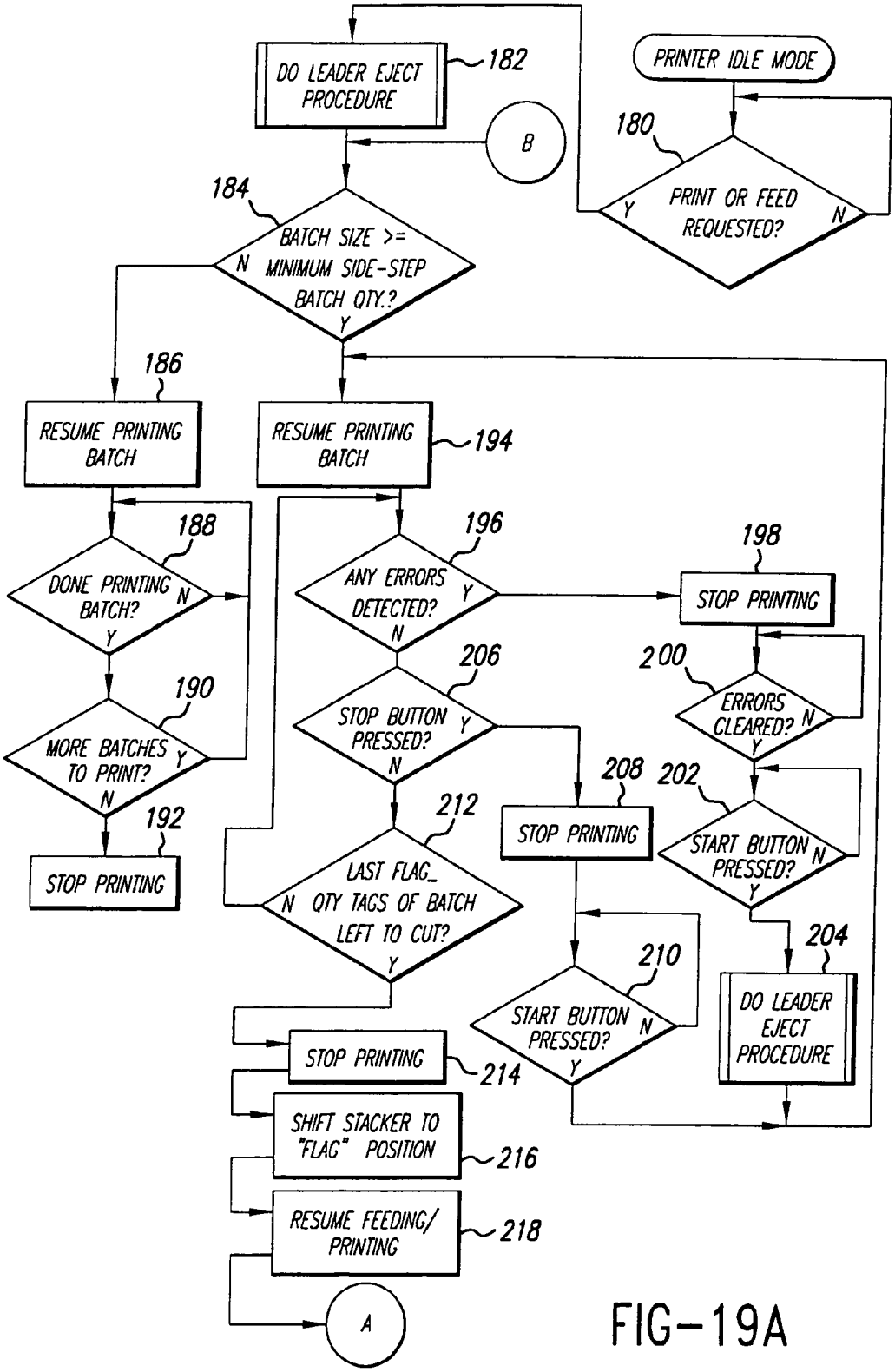
Figure 19B:
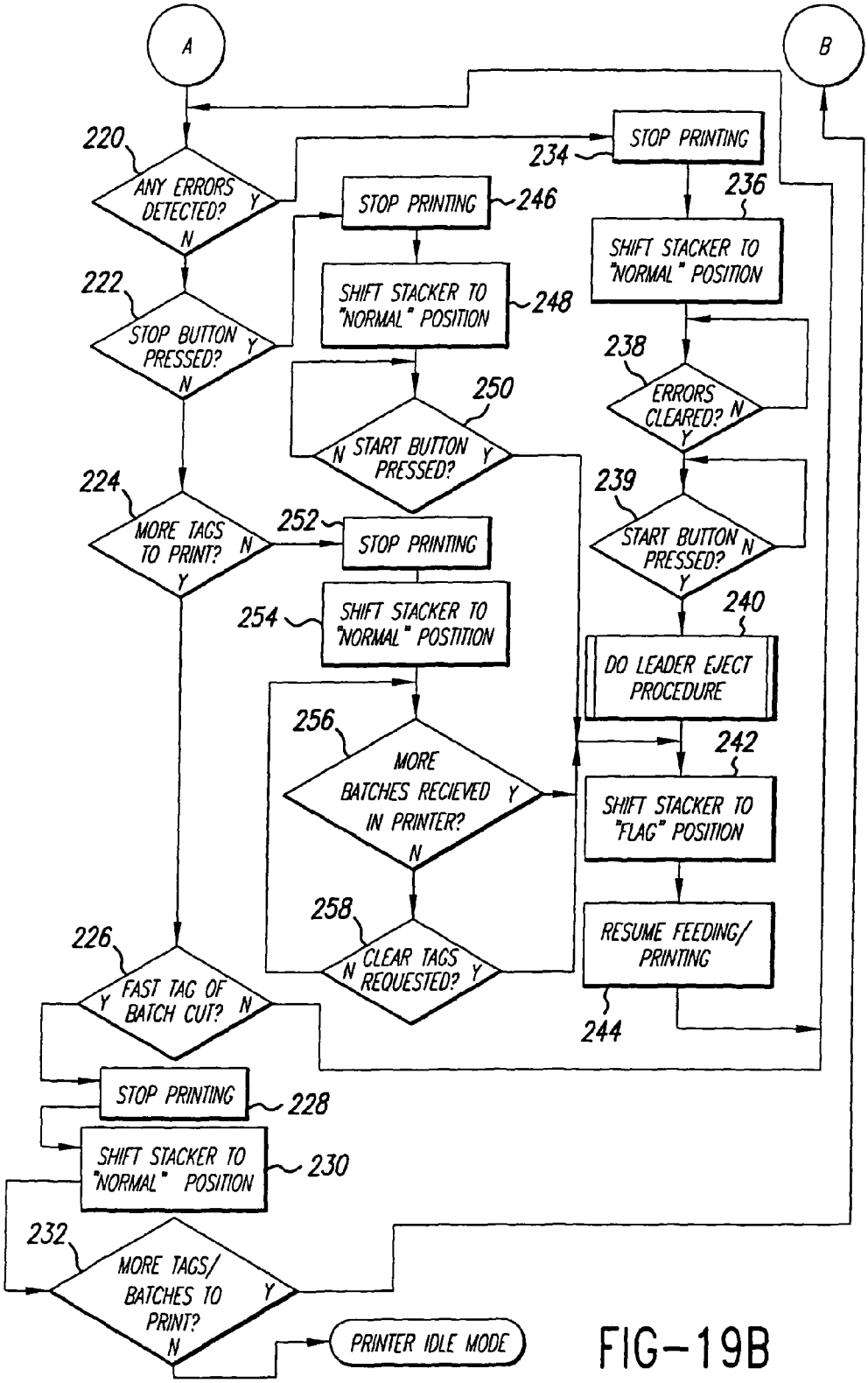
Figure 20:
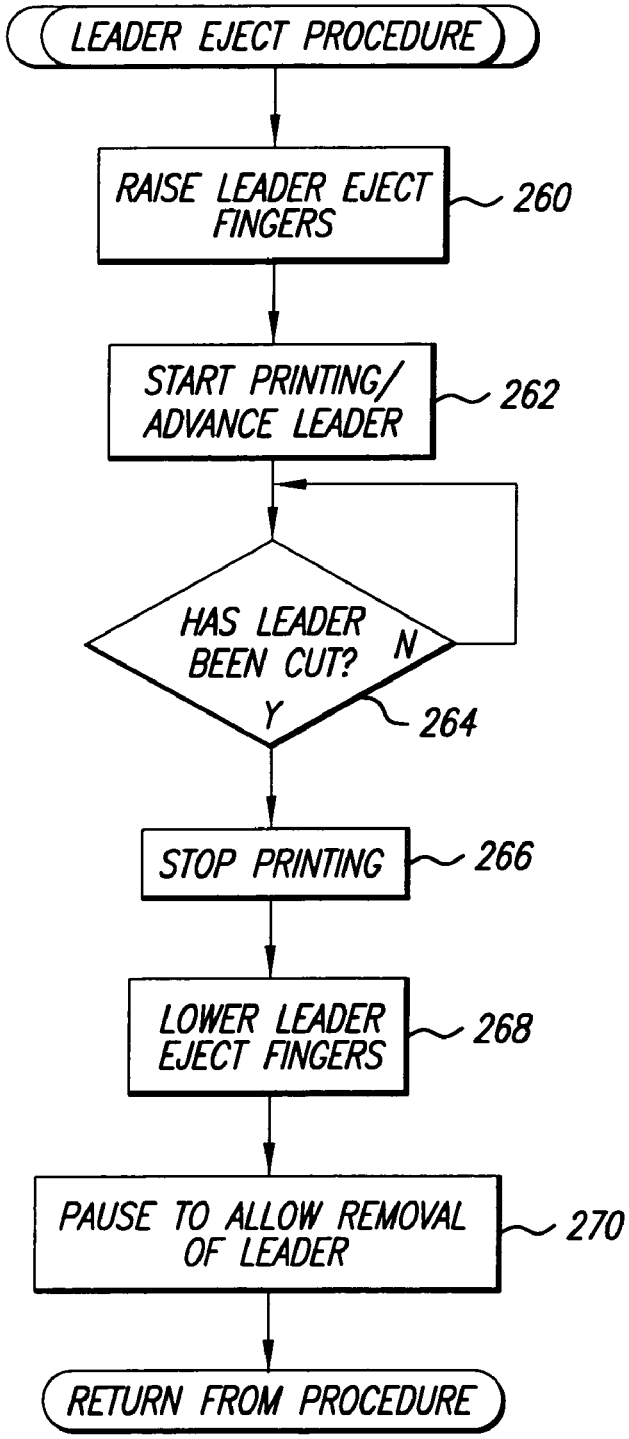

FIGS. 19A-B form a flow chart illustrating the operation of the microprocessor controlling the stacker; and FIG. 20 is a flow chart illustrating a leader eject procedure implemented by the microprocessor of the stacker.

DETAILED DESCRIPTION OF THE PREFERRED EMBODIMENTS

Figure 1:
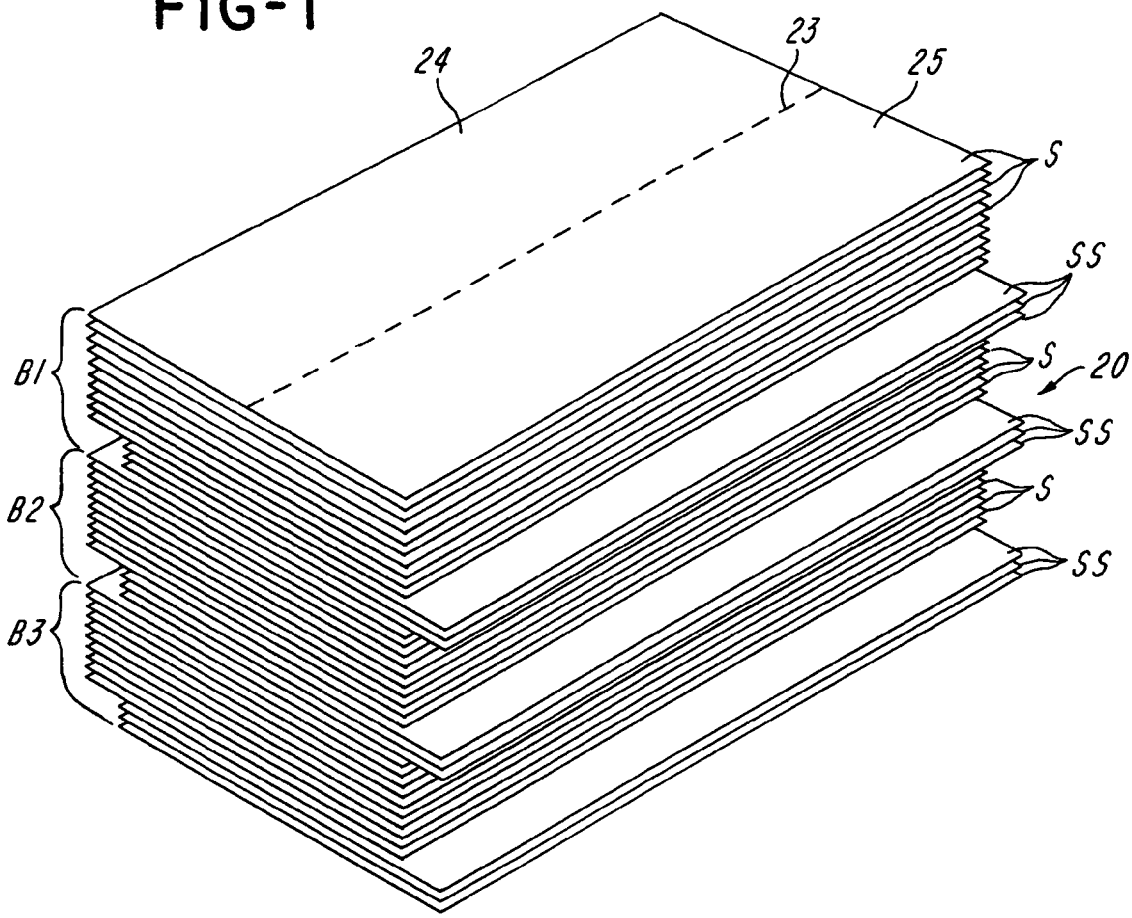
FIG. 1 is a perspective view of a stack of sheets such as composite labels or merchandise tags in accordance with the invention, however printed information is omitted for the sake of simplicity.

With reference to FIG. 1, there is shown a stack 20 of sheets S which may comprise a number of batches B1, B2, B3, and so on. The stack 20 can contain more or fewer than three batches. Each batch B1, B2 and B3 is shown to have a number of sheets S and a selected number of separator sheets or flags SS. Although three separator sheets SS are shown in each batch B1, B2 and B3, at least one separator sheet or more than three separator sheets SS can be used to define the end of a batch 20, if desired. The separator sheets SS not only indicate the end of a batch but also serve as a convenient place or tab by which an entire batch can be separated manually from the remainder of the stack. It may be that one sheet SS may be too flexible to enable a batch to be conveniently lifted from the stack, so more than one sheet SS may be used to define the end of a batch and to provide the desired stiffness. Nevertheless, a single sheet SS would effectively define the end of a batch. It is to be noted that the sheets S and SS are all the same size, although adjacent batches typically bear different information. The sheets S and SS of each batch B1, B2, B3 and so on contain the same information, however, the information is different from batch-to-batch, hence the need for batch separation. For example, the sheets S and SS in batch B1 may bear first information as shown on the sheet 21 in FIG. 2 and the sheets S and SS in batch B2 may bear second printed information as shown on sheet 22 in FIG. 3, the first and second printed information differing from each other, as shown. The batches B1, B2 and B3 may vary as to the number of sheets S per batch. If desired, each batch may be required to contain a minimum number of sheets S. Because all the sheets S and SS of each batch, such as B1, bear the same information there is no wasted sheet as is true in the case where separator sheets are merely blank. Also, it is a distinct advantage to have all the sheets of each batch identical, irrespective of whether they are sheets S or separator sheets SS.

Figure 2:
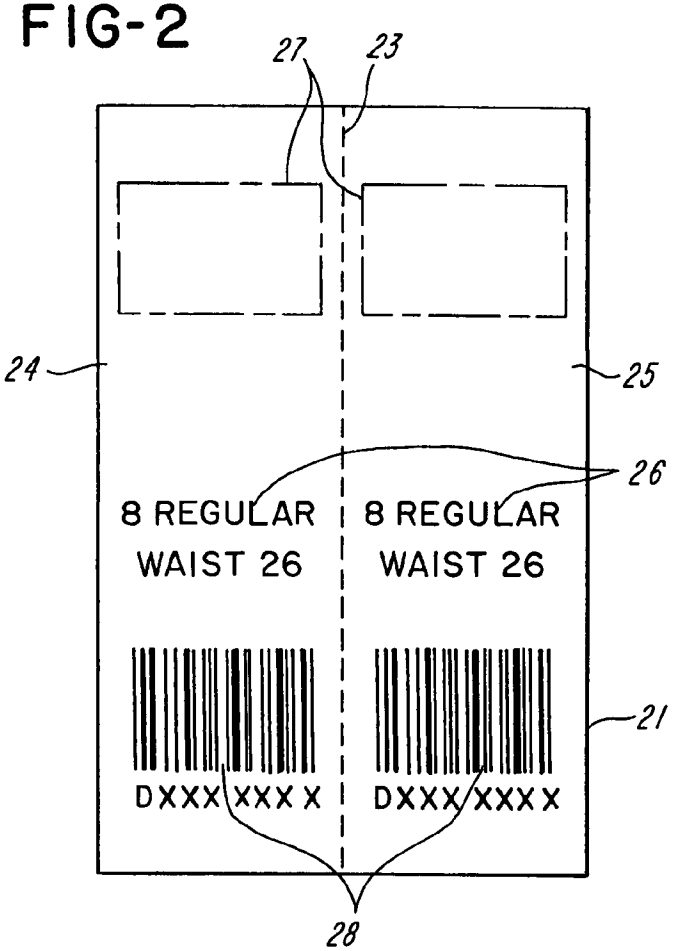
FIG. 2 is a top plan view illustrating a typical sheet containing first information of the type included in the stack of FIG. 1.

With reference to FIG. 2, a sheet 21 is shown to be generally rectangular, and in the instant example to have a line of weakening 23 formed by perforations dividing the sheet 21 into a two-part sheet, in particular, a two-part merchandise tag with manually separable tag parts 24 and 25. Both parts 24 and 25 can contain the same information such as size information 26, zones 27 for a logo, and zones 28 for a bar code and human readable information. The sheet 22 is identical to the sheet 21, except that the size information 29 differs from the size information 26, and the bar code and human readable information 30 differs from the bar code and human readable information 28. The sheets 21 and 22 can be of a typical size merchandise tag such as 5¾ inches by 3⅛ inches, however, other size sheets can be accommodated, as desired.

With reference to FIG. 4 there is shown diagrammatically how a web W progresses through a print station of a printer P with a print head 31. The desired information I is printed while the web W is uncut. The information I is more particularly depicted in FIGS. 2 and 3. As the web W continues to move, the web W is cut into sheets S, SS at a cutting station by a cutter 32. The separated sheets S or SS normally progress toward the stacker 33 along a straight feed path shown by arrow 34.

The method and apparatus of the invention includes the feature of ejecting the leader from the path 34. The expression "leader" in accordance with the invention includes that leading free end portion of the web W that is used to thread the printer P to a position past the cutter 32. The expression "leader" is also considered to include a sheet which is printed which is determined by a jam detector to be defective or to have jammed. A jam detector 106 detects an error signaled by an in-line bar code verifier (not shown). A jam sensor 107 located in the stacker 33 detects when a sheet that was intended to be received in the stacker 33 was in fact not received in the stacker 33. A defective sheet may also be created by the printer P when the print head 31 is moved to an open position which may cause a loss of print registration of information on the sheet. Such a condition would be detected by another jam detector (not shown). In any event, if any such error is detected, the leader eject procedure is followed. Leaders are ejected from the path 34 as indicated by phantom lines PL.

The stacker 33 includes a stationary stacker base 35 and a stacker carriage 36 movably mounted on the stacker base 35. It is to be noted that the stacker base 35 and the carriage 36 are shown in FIGS. 4 through 7 diagrammatically in outline only. FIG. 5 shows the stacker 33 with the stacker carriage 36 in the home position with one or more sheets S received on the stacker carriage 36. The stacker 33 is of the bottom-feed type and sheets S, SS are accumulated or fed one-by-one onto the stacker carriage 36 along path 34. For the sake of clarity, the stacker base 35 is shown aligned in all three figures, namely FIGS. 5, 6 and 7. When a predetermined number of sheets have been stacked on the stacker carriage 36, the stacker carriage 36 makes a side step or is shifted to another or flag or side step position as best shown in FIG. 6. With the carriage 36 in the flag position, the predetermined number of sheets SS are fed into the bottom of the stack 20 beneath the sheets S. The number of sheets SS in each batch is referred to as a side-step quantity. In the most preferred embodiment, three sheets SS are fed onto the stacker carriage 36 to form the bottom of the batch. Thus, in this most preferred embodiment, the minimum side-step quantity is three. The first batch B1 (FIG. 1) is now complete, and the stacker carriage 36 side steps again and is now returned to its home position shown also in FIG. 7. While it is most usual for numerous batches such as B1, B2, B3, and so on to be accumulated in the stack 20, it is possible to remove batch B1 immediately after it has been formed; the separator sheets SS, in this instance, serve as a convenient way to remove the batch B1 from the stacker carriage 36. Assuming that it is desired to build up the stack 20 with two or more batches, the sheets of batch B2 are now accumulated under the sheets S and SS of batch B1 while the carriage 36 is in the home position. When all the sheets S in batch B2 have been fed into the bottom of the stack 20, the carriage 36 is again shifted to the flag position shown in FIG. 6, and the separator sheets SS are fed beneath sheets S in batch B2. Batch B3 is accumulated in the same manner, first by adding sheets S below the previously attached batches B1 and B2 with the carriage 36 in the FIG. 5 or FIG. 7 or home position and thereafter shifting the carriage 36 to the FIG. 6 or flag position and adding sheets SS below the sheets S in batch B3, and so on. The result is a stack 20 as illustrated in FIG. 1.

Phantom lines 37 and 38 define the path 34 and show the locations of the sheets S and SS relative to each other and to the stacker carriage 36. FIG. 5 shows that all the sheets S are accumulated in the stacker 33 along the path 34. FIG. 6 shows that the sheets S have shifted out of the path between lines 37 and 38, but that sheets SS have been delivered along the path 34 between lines 37 and 38. FIG. 7 shows that when the carriage 36 has returned to the home position, the sheets S are in the paths 34 between lines 37 and 38 and the sheets SS are out of the path 34. It is apparent that the number of sheets in any batch B1, B2, B3, and so on can be any selected number. As shown the number of sheets S in each of batches B1, B2, B3 is different. It is also apparent that all the sheets S are generally aligned, and all the sheets SS are generally aligned, and that the sheets S and SS are offset or staggered. The batches B1, B2, B3, and so on are readily identified and separated at the separators SS. It is noted that the endmost or bottom separator sheet SS in batch B1 is adjacent and in contact with the first or upper sheet S in batch B2. Also, the endmost or bottom sheet S in batch B1 is adjacent and in contact with the uppermost sheet SS in batch B1. In the event only one separator sheet SS is used, the endmost or bottom sheet S in batch B1 would be in contact with the single separator sheet SS, and that separator sheet SS would, in turn, be adjacent and in contact with the endmost or uppermost sheet S in batch B2. The offset of sheets SS from sheets S can be any convenient amount. In the event the dimensions of the sheets are as stated above, by way of example not limitation, the offset can be ⅜ of an inch.

It should be noted that the path 34 of the sheets S and SS as they enter the carriage 36 is straight and does not change, and that the offset is achieved by shifting the carriage 36 relatively so that all the sheets S are accumulated while the carriage 36 is in the home position and all the sheets SS are accumulated while the carriage 36 is in the other or advanced or flag position.

Figure 8:
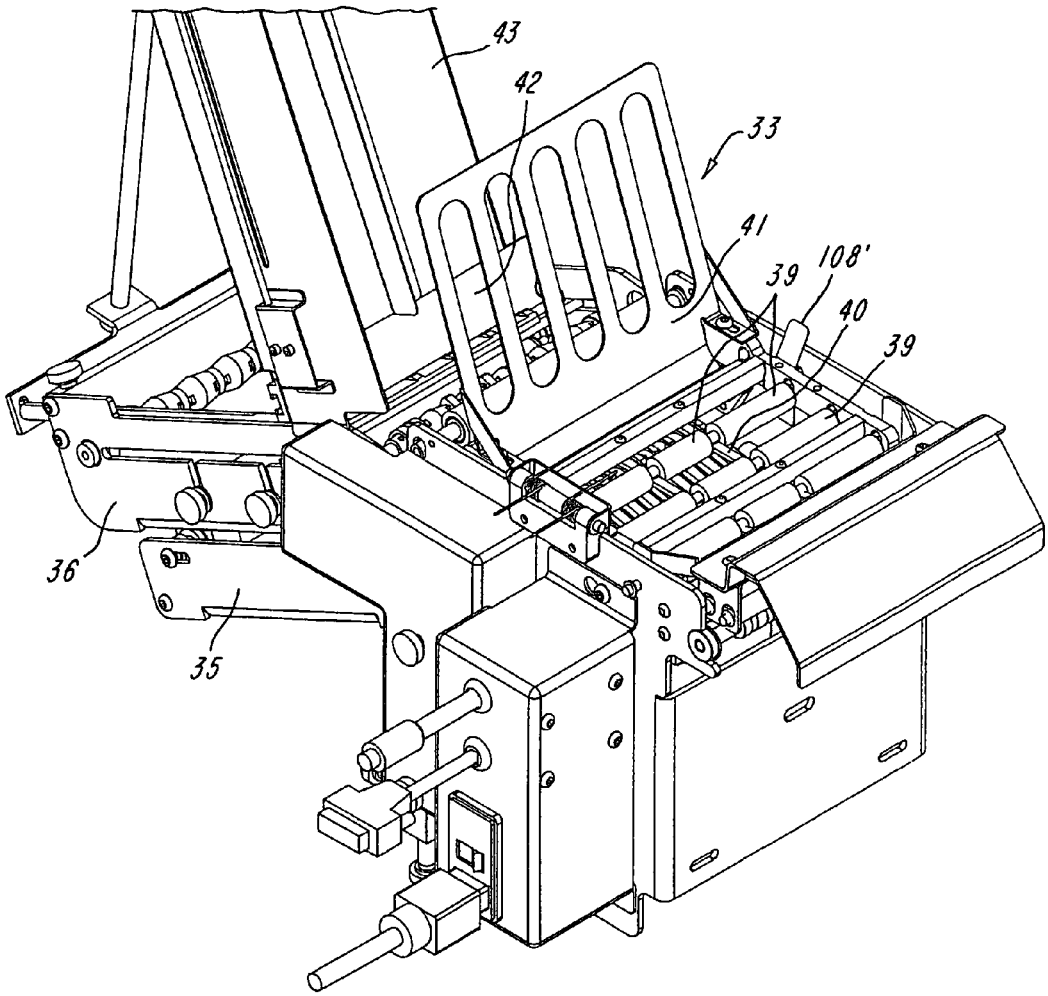
FIGS. 8 and 9 are perspective assembled views of the stacker.

With reference to FIG. 8, there is shown the stacker 33 which receives sheets S, SS between rollers 39 and endless belts 40 below the rollers 39. All sheets S, SS pass onto the stacker carriage 36, except for the leader and rejected sheets which are deflected onto an inclined chute 41. The sheets S, SS are arrested by a stop 42 on the carriage 36. As sheets S and SS are received, the sheets S and SS are stacked and ride up an inclined plate 43.

Figure 9:
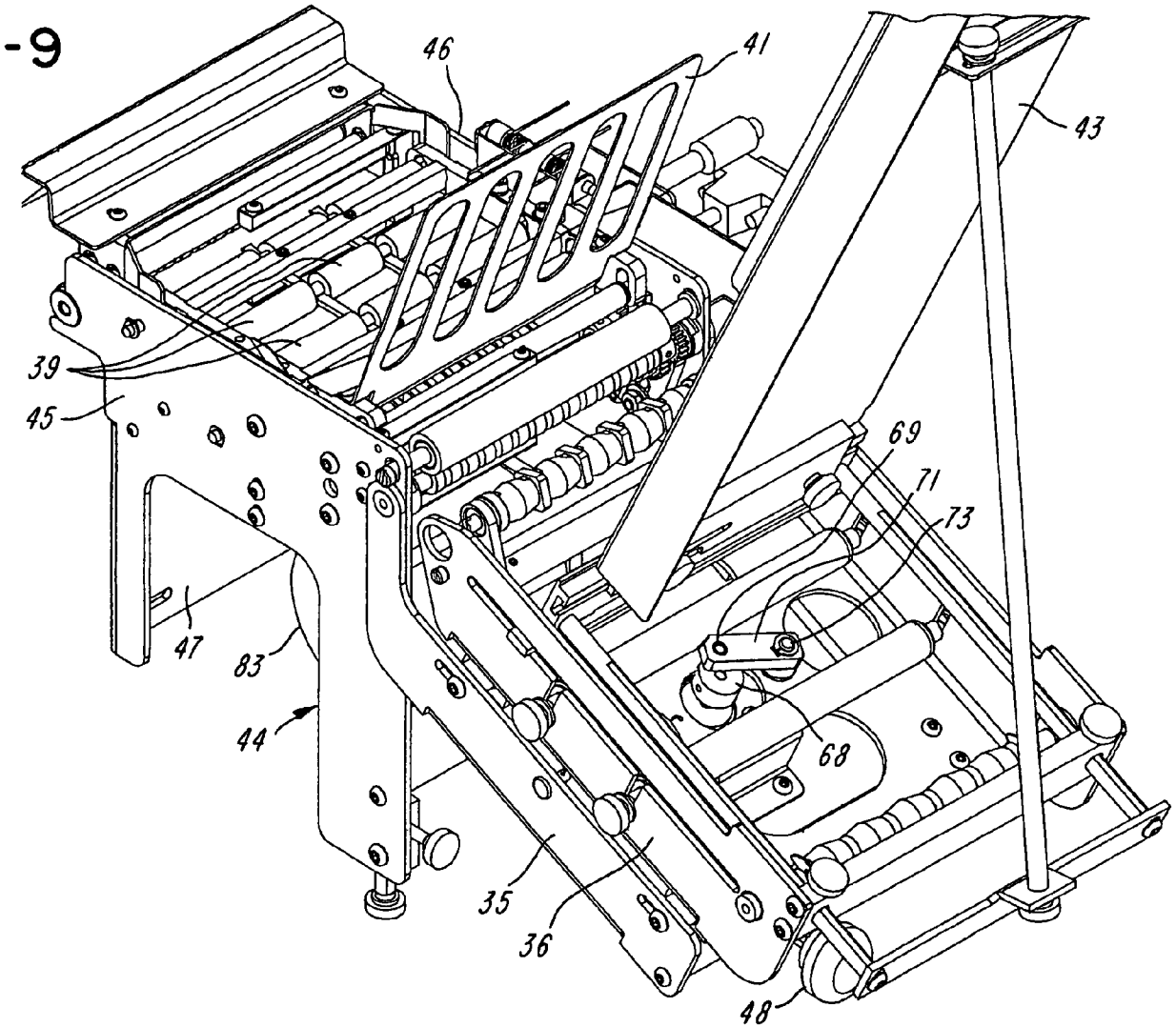

FIG. 9 shows the stacker base 35 connected to a frame generally indicated at 44 having frame plates 45 and 46 by means of a plate 47. By turning a knob 48, the inclination of stacker base 35 and, in turn, of the entire stacker carriage 36 can be changed.

Figure 10:
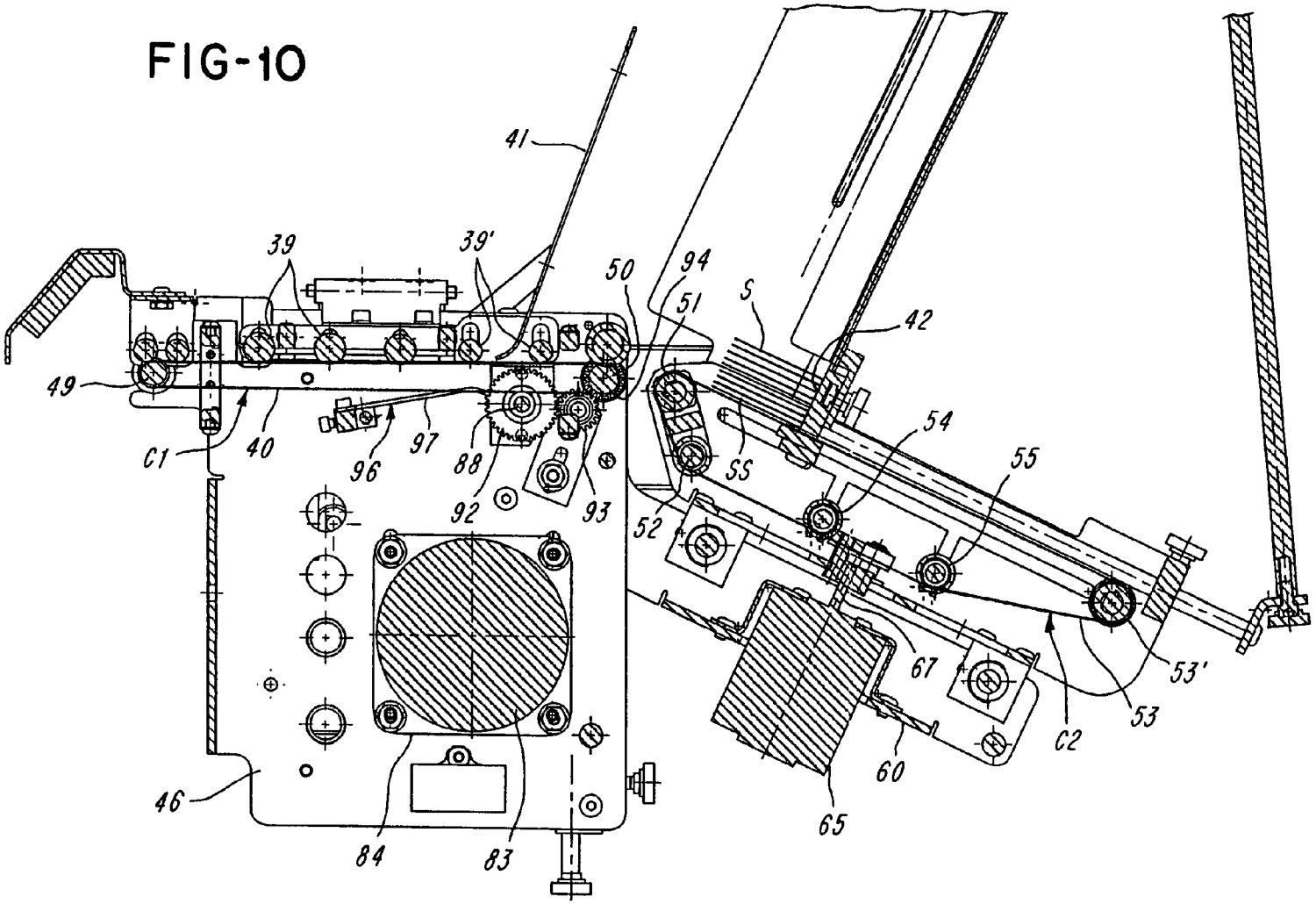
FIG. 10 is a sectional view through the stacker.

As shown, in FIG. 10, the belts 40, which are trained about rolls 49 and 50, comprise a conveyer C1 which feeds the sheets S and SS to a position above the driven roll 51. Laterally spaced belts 53 passing about rolls 51, 52, 53', 54 and 55 comprise a conveyor C2 to advance the sheets S and SS to the position shown in FIG. 10 against the plate or stop 42.

Figure 11:
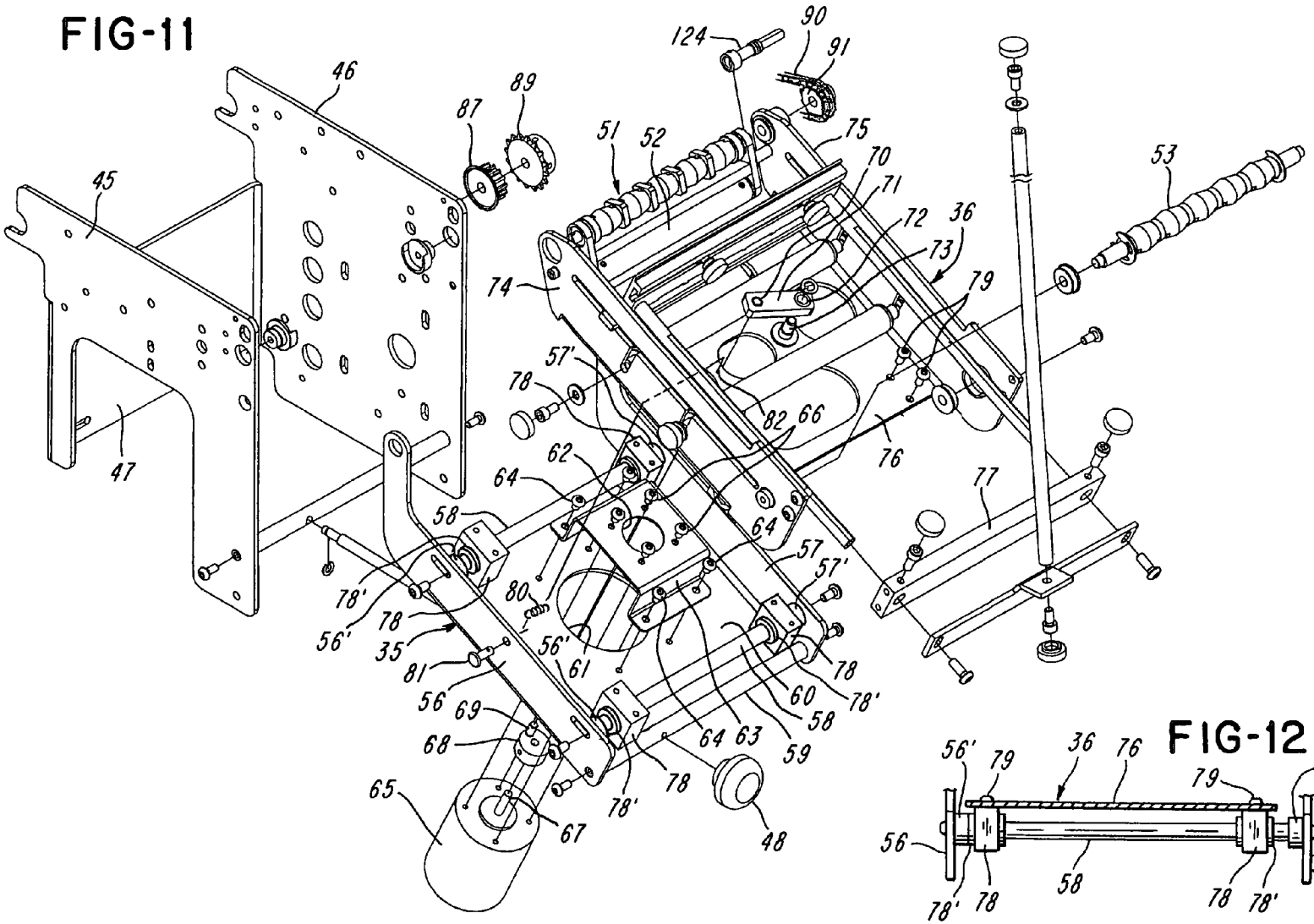
FIG. 11 is an exploded perspective view of portions of the stacker.

As shown in FIG. 11, the stacker base 35 includes a pair of plates 56 and 57 connected by a pair of shafts 58 and 59 and a plate 60 into a rigid assembly. The plate 60 has a hole 61 aligned with a hole 62 in a bracket 63. The bracket 63 is secured to the plate 60 by four screws 64. The bracket 63 mounts a shift motor 65 by means of four screws 66. Motor shaft 67 mounts a crank 68 having a pin 69. The pin 69 is pivotally received in a hole 70 in a link 71. The link 71 has a hole 72 which pivotally receives a pin 73. The stacker carriage 36 has a pair of side plates 74 and 75 rigidly connected by a plate 76 to which the pin 73 is secured, and by a bar 77. Four mounting blocks 78 slidably mount the carriage 36 on shafts 58. The blocks 78 are secured to the plate 76 by four pairs of screws 79, only one pair of which is shown in FIG. 11. The carriage 36 is capable of side-stepping or shifting laterally relative to the base 35 when driven laterally. Upon energization of the motor 65 and rotation of motor shaft 67 through a partial revolution, the crank 68 rotates so that the pin 69 drives the pin 73 laterally through the link 71, thereby moving the carriage 36 from the home position to an advanced or flag position, illustrated in FIG. 6. Also, FIG. 11 shows the blocks 78 in the flag position; in particular, the bearings 78' are against stops or resilient bumpers 57. Conversely, the two bearings 78' at the left side of FIG. 1 are shown spaced from stops or bumpers 56'. When the shift motor 65 is engaged, the shift motor 65 drives the carriage 36 until the stops 57 contact related bearings 78', whereupon the carriage 65 is in the flag position whereupon the shift motor 65 stalls. The motor 65 continues to be energized to hold the carriage 36 in the flag position until a signal from the microprocessor 105 causes the motor 65 to be de-energized. In particular, the motor 65 is held energized until the last separator sheet SS in a batch has been fed into the stacker carriage 36, whereupon a signal from microprocessor 105 de-energizes the motor 65 and a tension spring 80 connected at one end to a pin 81 and at its other end to a hole 82 in the plate 76 drives the stacker carriage 36 from the flag position to the home position. The motor 65 drives the carriage 36 laterally in one direction and is considered to be a driver, and the spring 80 drives the carriage 36 in the opposite direction and is also considered to be a driver. This arrangement is preferred because the carriage 36 is in the home position while sheets S are being accumulated on the carriage 36 and it is only during a short period of time when a sheet or sheets SS are being accumulated in the carriage 36 that the motor 65 needs to be energized. At all other times when the carriage 36 is in the home position, there is no need to energize the motor 65, because return of the carriage 36 to the home position and retaining the carriage 36 in the home position is caused by the spring 80. Therefore, it is apparent that during operation of the stacker 33 energy is only supplied to the motor 65 to drive the carriage 36 to the flag position and to hold it there while the sheet or sheets SS are being fed onto the carriage 36. While the motor 65 and the associated crank 68, link 71 and pins 69 and 73 could alternatively be used to drive the carriage in both lateral directions, that is, from the home position to the flag position and from the flag position to the home position, the illustrated arrangement is preferred.

Figure 12:
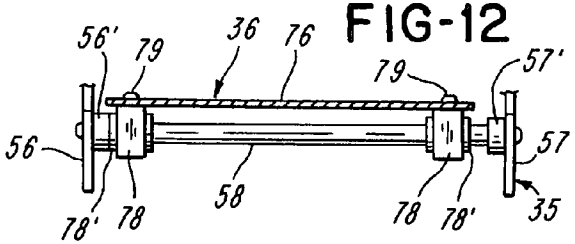
FIG. 12 is a partly sectional view showing the manner in which the carriage is mounted on the stacker base.

With reference to FIG. 12, the carriage 36 is shown in the home position with the bearing 78' against the stop or bumper 56', and is held there by the spring 80 until the force of the spring 80 is overcome by the shift motor 65.

Figure 13:
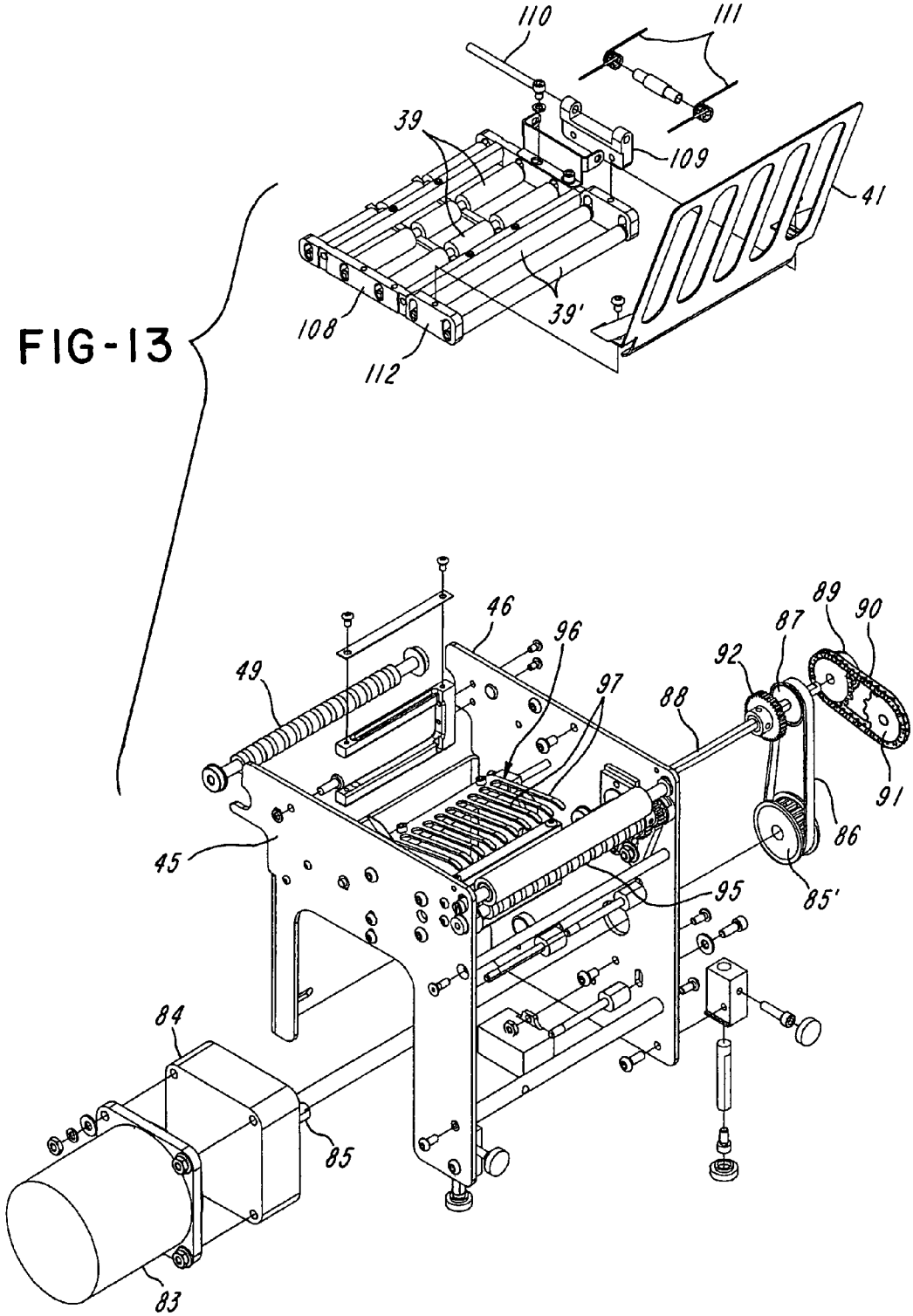
FIGS. 13 and 14 are exploded perspective views of the stacker.

With reference to FIG. 13, there is shown a belt drive motor 83 drivingly coupled to a speed reducer 84 secured to the plate 46 by screws. Output shaft 85 of the speed reducer 84 drives a toothed pulley wheel 85', which, in turn, drives a toothed endless driver member specifically a toothed belt 86. The belt 86 drives a toothed pulley wheel 87 secured to a shaft 88. A sprocket 89 secured to the shaft 88 drives an endless drive member specifically a roller chain 90 which, in turn, drives a sprocket 91. The sprocket 91, also shown in FIG. 15 selectively drives either the roll 51 or the roll 52.

With reference to FIG. 10, a gear 92 secured to the shaft 88 drives a gear 93 which, in turn, drives a gear 94. The gear 94 is secured to a grooved roll 95 (FIG. 13) about which laterally spaced belts 40 are trained. The roll 49 is also grooved and the belts 40 are also trained about the roll 49. The belts 40 are omitted from FIGS. 9, 13 and 14 for the sake of clarity.

Figure 14:
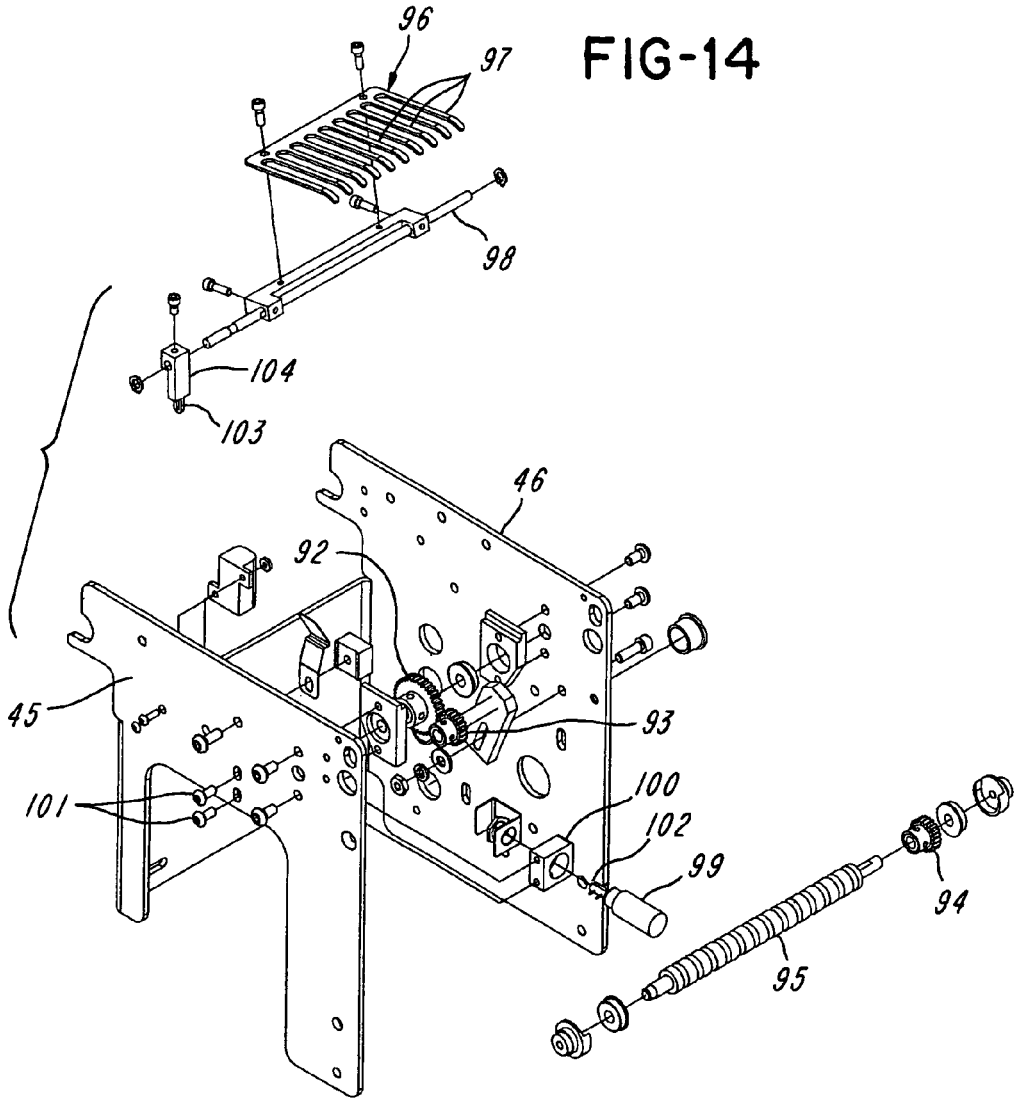

FIGS. 10, 13 and 14 show a gate or ejector 96 having a plurality of eject fingers 97. The fingers 97 are sized and spaced to fit between the belts 40. The gate 96 is secured to a pivotally mounted shaft 98 rotatable in plates 45 and 46. A solenoid 99 secured in a block 100 is mounted to the plate 45 by screws 101. Armature 102 of the solenoid 99 is coupled to a pin 103 on an arm 104. The arm 104 is secured to the shaft 98. When the solenoid 99 is energized, the fingers 97 are raised, that is, pivoted counterclockwise (FIG. 10) to a position above the upper pass of the belts 40 to cause a leader to be ejected and ride up the chute 41. A leader is ejected under the control of a microprocessor 105 (FIG. 15) in the event a jam is sensed by jam sensors 106 and 107. A perceived jam can occur when a sensor 106 or 107 senses that there is a condition which may cause a loss of registration, a jam or other print error, as when the print head 31 is moved to an open position or a printing error occurs as sensed by the other sensor. When the condition has been cleared, the solenoid 99 is de-energized and the fingers 97 are lowered or return gravitationally to their home position shown in FIG. 10.

As shown in FIG. 13, the rollers 39 are rotatably and floatingly mounted in a frame 108 secured to the plate 46. The frame 108 is pivotally mounted to a bracket 109 by a pivot pin 110. Spiral springs 111 urge the frame 108 to an open position clockwise from the position shown in FIG. 13 to enable a jam or a stray sheet S to be cleared. A latch 108' (FIG. 8) normally holds the rollers in the position shown in FIGS. 8, 9 and 13 to hold the sheets S and SS against the upper pass of the belts 40. Downstream of the rollers 39 are rollers 39' (FIG. 13) which are rotatably and floatingly mounted in a frame 112, which is, in turn, mounted to the plates 45 and 46.

Figure 15:
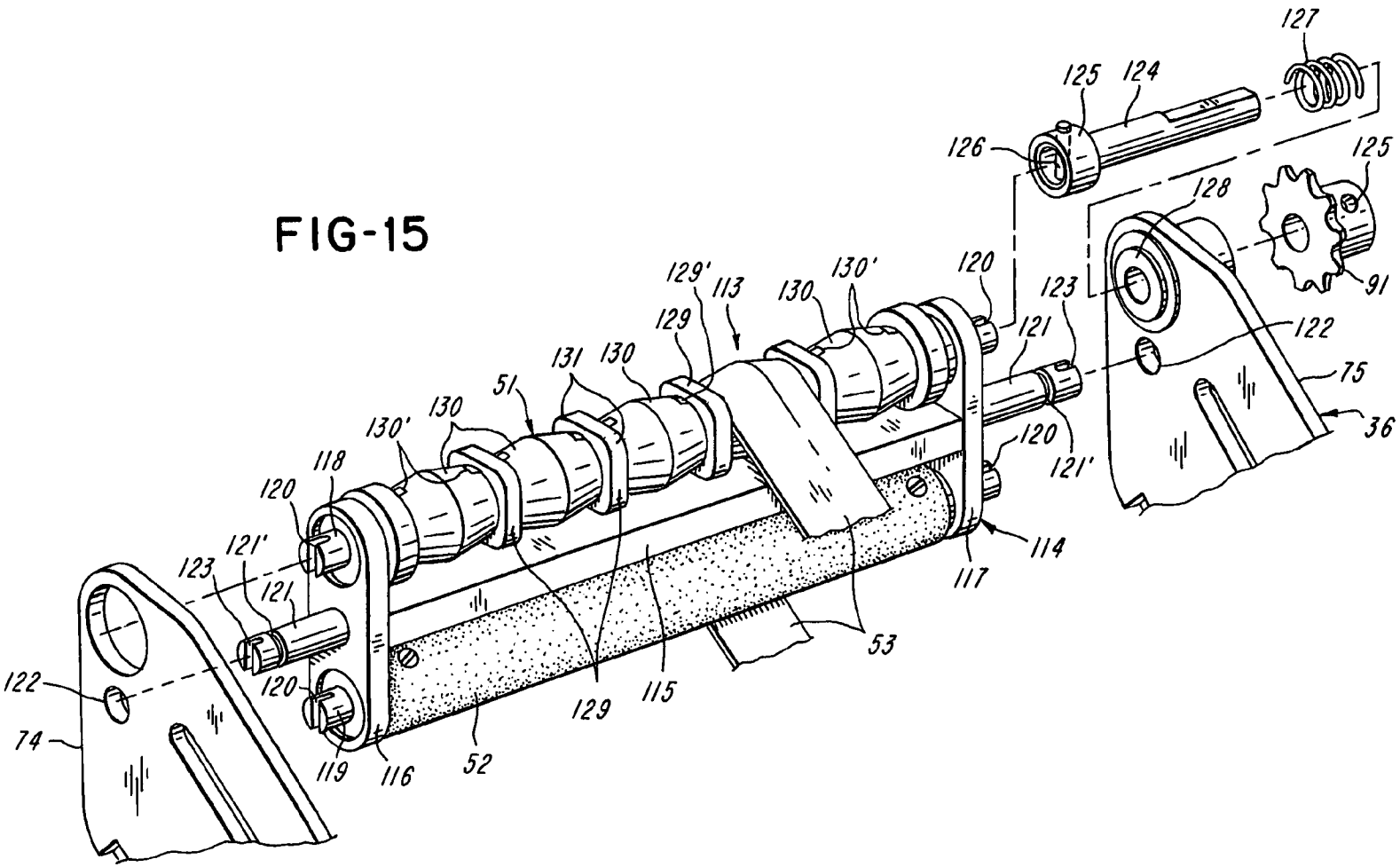
FIG. 15 is an exploded perspective view of components of a sheet feed mechanism or sheet feeder of the stacker.

With reference to FIG. 15, there is shown an arrangement by which a sheet feed mechanism or sheet feeder generally indicated at 113 can be used to feed sheets having different characteristics or types. A turret 114 is shown to include a bar 115 and a pair of end plates 116 and 117 secured to the bar 115. The end plates 116 and 117 rotatably mount the rolls 51 and 52. The rolls 51 and 52 include respective identical shafts 118 and 119 having slots 120 at opposite end portions. Shaft end portions 121 secured to the end plates 116 and 117 rotatably mount the turret 114 and project through holes 122 in plates 74 and 75. The shaft end portions 121 have respective slots 123 which aid in assembly. Grooves 121' receive E-rings (not shown) in grooves 121' outboard of the plates 74 and 75 to prevent the shaft 121 from shifting during use.

The sprocket 91 is secured to a drive shaft 124 by a set screw (not shown) received in a threaded hole 125. A tubular socket 125 is secured to one end of the shaft 124. A pin 126 extends through the center of the socket 125 and is secured therein. A compression spring 127 received about the drive shaft 124 between a bearing 128 in the plate 75 and the socket 125 urges the shaft 124 and the socket 125 toward the left as shown in FIG. 15. The pin 126 can fit into the slot 120 of either shaft 118 or 119 at the right end (FIG. 15) thereof depending upon the position of the turret 114. As shown, the pin 126 can line up with the slot 120 at the right end of shaft 118 in the position shown in FIG. 15. By shifting the shaft 124 and the associated socket 125 to the right against the action of the spring 127, the pin 126 can uncouple from the slot 120 in the shaft 118 and the turret 114 can be rotated manually to bring the slot 120 at the right end of the shaft 119 into alignment with the pin 126, and when released the spring 127 can move the shaft 124 and the socket 125 toward the left (FIG. 15) to couple the drive shaft 124 to the shaft 119 of the roll 52. It is to be understood that there is enough distance between the socket 125 and the bearing 128 to enable the shaft 124 to be shifted to the right to uncouple the socket 125 and its pin 126 from the end portion of either the shaft 118 or the shaft 119 as the case may be so that the turret 114 can be rotated. Also, the sprocket 91 is secured to the drive shaft 124 at a location which will enable the drive shaft 124 to slide to the left far enough so that the pin 126 is drivingly engaged with either slot 120 at the right end of the shaft 118 or 119 with which the shaft 124 is aligned. The spring 127 holds the shaft 124 and its socket 125 releasably coupled to either shaft 118 or 119 with which the shaft 124 is aligned. Therefore, the drive shaft 124 can selectively drive either the shaft 118 or 119 which is aligned with the drive shaft 124.

Figure 16:
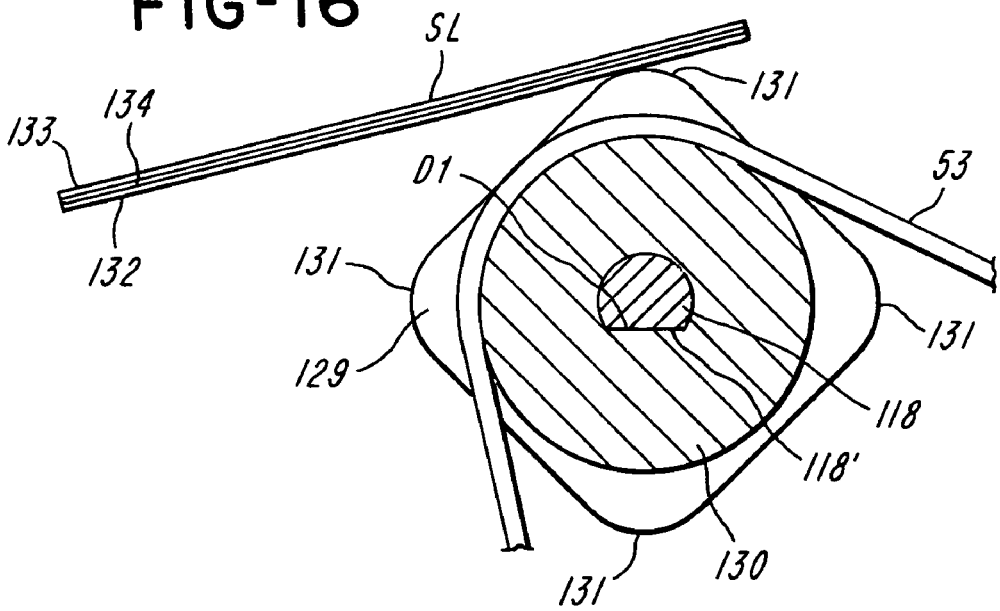
FIG. 16 is a sectional view showing how the square wheel members feed a composite label sheet.

The roll 51 is comprised of generally square roll members 129 spaced apart by crown roll members 130. The roll members 129 have integrally formed keys 129 received in notches 130' in roll members 130. The crown roll members 130 are used for spaced belts 53, only one of which is shown in FIG. 15. The shaft 118 has a flat 118' which matches a D-shaped hole D1 in roll members 129 and 130 to key the roll members 129 and 130 to the shaft 118. The square roll members 129 have radiused corners 131. The shape of the square rolls 129 is particularly useful in feeding composite pressure sensitive labels SL as depicted in FIG. 16 because they help feed and settle the labels SL in the stacker 33. The four sides of the square wheel members 129 are along a tangent to the outer sides of the belts 53 so the belts 53, which are frictional feed members, can also impart feeding force to the labels SL in the event the belts 53 contact the labels SL in certain positions of the wheel members 129. The labels SL have a siliconized release liner 132 to which labels 133 are releasably adhered by pressure sensitive adhesive 134 as shown in FIG. 16. Although the underside of the release liner 132 is not siliconized, it is commonly of a slicker or smoother material than a merchandise tag would be. Therefore, a combination of roll members 129 and 130 and belts 53 is effective to feed composite label sheets or labels. The square roll members 129 and the belts 53 are preferably composed of a frictional material, for example, polyurethane.

Figure 3:
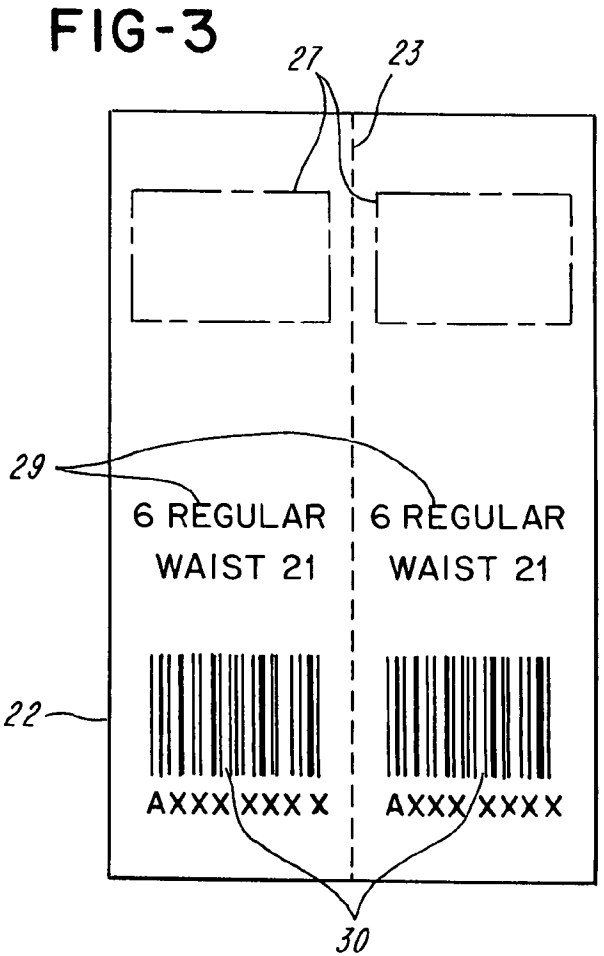
FIG. 3 is a top plan view illustrating a typical sheet containing second information of the type included in the stack of FIG. 1.
Figure 17:
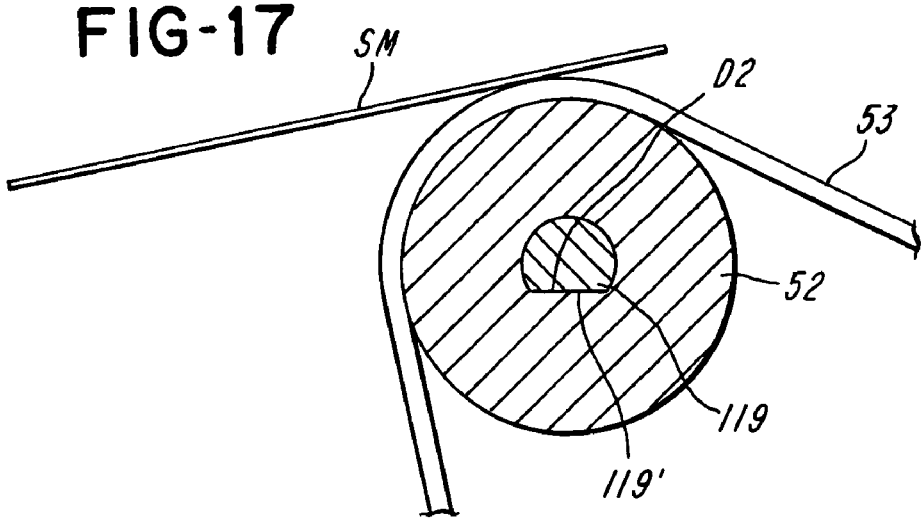
FIG. 17 is a sectional view showing how the belts feed a merchandise tag.

When it is desired to feed sheets such as merchandise tags SM shown in FIGS. 2, 3 and 17, it is preferred to use the belts or frictional feed members 53 themselves to feed the tags SM, as depicted in FIG. 17, onto the stacker carriage 36. A flat 119' on the shaft 119 matches a D-shaped hole D2 in the roll 52. The roll 52 therefore rotates as a unit with the shaft 119 to enable the belts 53 to feed the tags SM when the shaft 119 is coupled to the drive shaft 124.

It should be noted with reference to FIG. 10, that irrespective of which roll 51 or 52 is being driven by the shaft 124, the belts 53 pass partially around and drive rolls 51 and 52, even though only the roll 51 or the roll 52 which is coupled to the shaft is able to feed labels SL or merchandise tags SM onto the stacker carriage 36.

While it is known in the prior art to use a roll like the roll 51 to feed composite pressure sensitive labels and to use a roll like the roll 52 and belts like the belts 53 to feed merchandise tags, their use required partial disassembly of the sheet feeder to replace one type of feed roll (like the feed roll 51) for another type of feed roll (like the feed roll 52). By use of the arrangement disclosed herein, the changeover can be made quickly without incurring any substantial downtime or the loss of adjustment of components of the sheet feeder and without even partial disassembly of the stacker 33.

Figure 18:
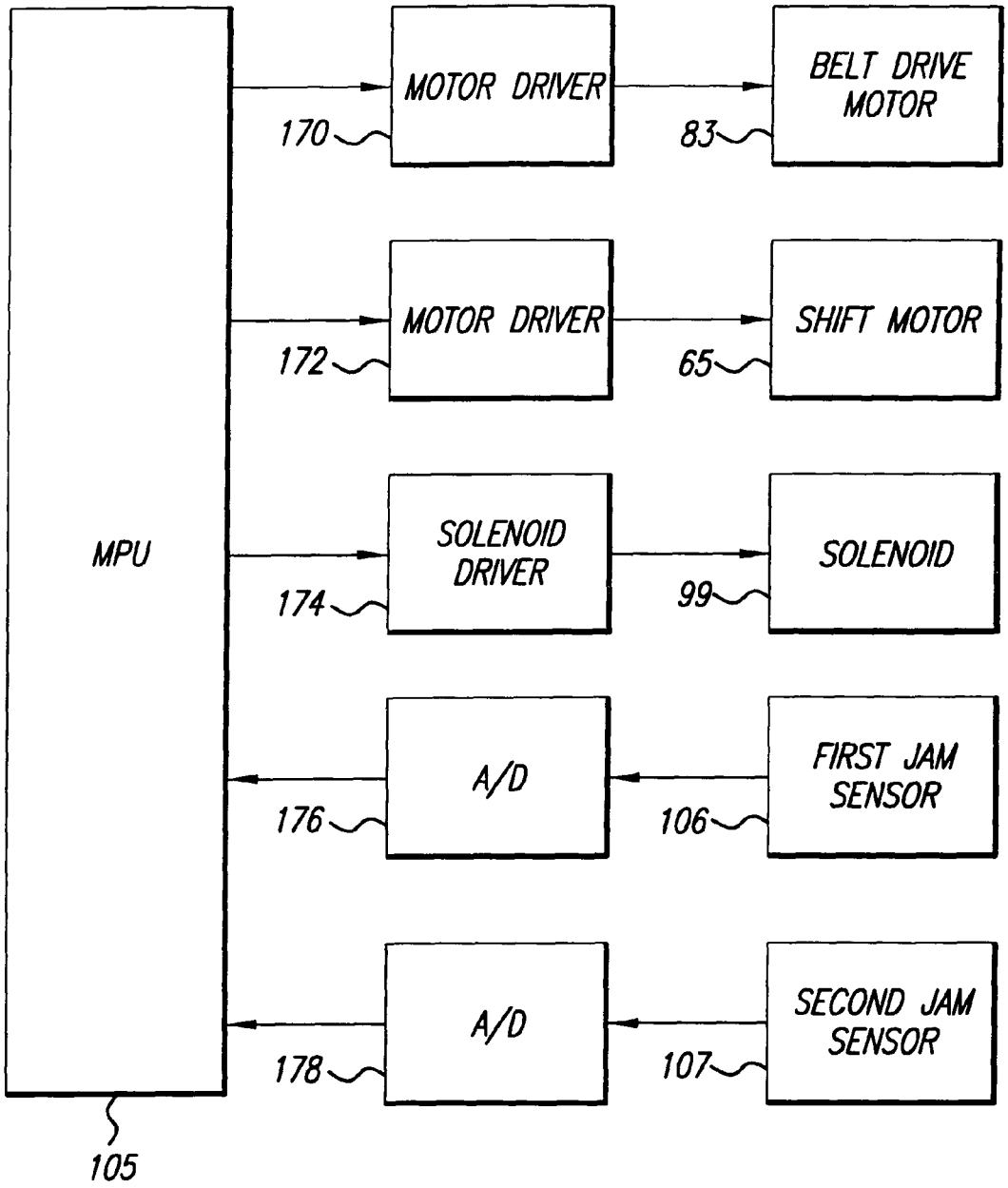
FIG. 18 is a block diagram of the stacker.

As shown in FIG. 18, the microprocessor 105 controls the belt drive motor 83 and the shift motor 65 via respective motor drivers 170 and 172. The microprocessor also controls the solenoid 99 via a solenoid driver 174. The first jam sensor 106 is coupled to the microprocessor 105 via an analog to digital converter 176 and the second jam sensor 107 is coupled to the microprocessor 105 via an analog to digital converter 178. The microprocessor 105 controls the operation of the stacker 33 in accordance with software stored in a memory associated with the microprocessor 105, the software being depicted in the flow charts of FIGS. 19A-B and 20.

As shown in FIGS. 19A-B, the microprocessor 105 while in the printer idle mode, determines at a block 180 whether a print or feed has been requested. If so, the microprocessor 105 proceeds to block 182 to implement a leader eject procedure so as to eject or remove the leader portion of the tag stock that is used to initially thread the tag stock through the printer. The leader eject procedure is described in detail below with regard to FIG. 20. After performing the leader eject procedure at block 182, the microprocessor 105 proceeds to block 184. At block 184, the microprocessor 105 determines whether the batch size is greater than or equal to a minimum side-step batch quantity. The minimum side-step batch quantity is a programmable value that represents the minimum number of tags in a batch that is required for the stacker to shift to the flag position to provide offset separator sheets SS. If the batch size is less than the minimum side-step batch quantity, the microprocessor 105 proceeds from block 184 to block 186 to resume printing the batch. At block 188, the microprocessor 105 determines whether printing of the current batch has been completed and if so, the microprocessor proceeds to block 190. At block 190, the microprocessor 105 determines whether there are more batches to print. If there are more batches to print, the microprocessor 105 returns to block 188. It should be appreciated that, in an alternative embodiment, if there are more batches to print, the microprocessor may proceed from block 190 to block 184 instead of block 188 to determine whether the next batch is of a size that will permit the side-step action of the stacker. If the microprocessor 105 determines at block 190, that there are no more batches to be printed, the microprocessor stops the printing operation at block 192.

The microprocessor 105 proceeds from block 184 to block 194 when it determines that the batch size is greater than or equal to the minimum side-step batch quantity. At block 194, the microprocessor 105 resumes printing the batch. At block 196, the microprocessor 105 determines whether any errors have been detected based on inputs from the first and/or second jam sensors 106, 107, for example. If the microprocessor detects errors, it proceeds to block 198 to stop printing. Thereafter, at block 200, the microprocessor 105 determines whether the errors have been cleared. If the errors have been cleared, the microprocessor 105 determines at block 202 whether the start button has been pressed. If so, the microprocessor 105 at block 204 implements the leader eject procedure depicted in FIG. 20 to eject the web stock associated with the detected error. If the microprocessor 105 determines at block 196 that no errors have been detected, the microprocessor at block 206 determines whether the stop button has been pressed. If the stop button has been pressed, the microprocessor proceeds from block 206 to block 208 to stop printing. Thereafter, at block 210, the microprocessor 105 determines whether the start button has been pressed and if so, the microprocessor returns to block 194 to resume printing the batch. If the stop button has not been pressed, the microprocessor 105 proceeds from block 206 to block 212.

At block 212, the microprocessor 105 determines whether the last Flag_QTY tags of the batch are left to cut. The Flag_QTY is a variable representing the number of flag tags that are to be shifted or offset so as to form separator sheets. If the microprocessor 105 determines at block 212 that the number of tags of a batch that are left to cut is equal to the number represented by Flag_QTY, the microprocessor stops printing at block 214 and at block 216, the microprocessor 105 shifts the stacker carriage 36 to the flag position. After shifting the stacker carriage 36 to the flag position, the microprocessor 105 at block 218 resumes feeding/printing. Thereafter, the microprocessor 105 proceeds to block 220 to determine whether any errors are detected. If no errors have been detected, the microprocessor at block 222 determines whether the stop button has been pressed and if not, the microprocessor 105 proceeds to block 224. At block 224, the microprocessor 105 determines whether there are more tags or labels to be printed. If so, the microprocessor proceeds to block 226 to determine whether the last tag of the batch has been cut. If the last tag of the batch has been cut, the microprocessor 105 at block 228 stops printing. Thereafter, at block 230, the microprocessor 105 enables the spring 80 to shift the stacker carriage 36 from the flag position back to the normal stacking position. At block 232, the microprocessor determines whether there are more tags/batches to print. If so, the microprocessor 105 proceeds from block 232 back to block 184 to determine whether the next batch is of a size that is greater than or equal to the minimum side-step batch quantity.

The microprocessor 105 proceeds from block 220 to block 234 if errors such as a jam has been detected at block 220. At block 234, the microprocessor stops printing in the event of a jam and at block 236, the microprocessor 105 enables the spring 80 to shift the stacker carriage 36 from the flag position back to the normal position so that the jam/error can be cleared. At block 238, the microprocessor determines whether the errors have been cleared and if so, the microprocessor proceeds to block 239. At block 239, the microprocessor determines whether the start button has been pressed and if so, the microprocessor 105 at block 240 implements the leader eject procedure depicted in FIG. 20. After the leader eject procedure has been implemented, the microprocessor 105 at block 242 shifts the stacker carriage 36 back to the flag position from the normal position and resumes feeding/printing in the flag position at block 244. Thereafter, the microprocessor proceeds back to block 220.

The microprocessor 105 proceeds from block 222 to block 246 when it determines at block 222 that the stop button has been pressed while the stacker is in the flag position. At block 246, the microprocessor 105 stops the printing and at block 248 the microprocessor 105 shifts the stacker from the flag position back to the normal position. Thereafter, the microprocessor 105 determines whether the start button has been pressed at block 250 and if so, the microprocessor 105 proceeds to block 242 to shift the stacker carriage 36 back to the flag position from the normal position and to resume feed/printing in the flag position at block 244. The microprocessor proceeds from block 224 to block 252 to stop printing when the microprocessor 105 has determined at block 224 that there are no more tags to be printed. After stopping the printing, the microprocessor 105 proceeds from block 252 to block 254 to enable the spring 80 to shift the stacker carriage 36 from the flag position to the normal position. Thereafter, the microprocessor 105 at block 256 determines whether there are more batches received in the printer. If not, the microprocessor 105 proceeds to block 258 to determine whether clear sheets or tags have been requested and if so, the microprocessor 105 proceeds from block 258 to block 242.

Upon entering the leader eject procedure depicted in FIG. 20, the microprocessor 105 at block 260 raises the leader eject fingers. Thereafter, at block 262, the microprocessor 105 starts printing/advancing the leader. At block 264, the microprocessor 105 determines whether the leader has been cut and if so, the microprocessor proceeds from block 264 to block 266 to stop printing. At block 268, the microprocessor lowers the leader eject fingers and at block 270, the microprocessor

105 pauses to allow the removal of the leader. The microprocessor 105 then returns to the printer idle mode depicted in FIGS. 19A-B.

Other embodiments and modifications of the invention will suggest themselves to those skilled in the art, and all such of these as come within the spirit of this invention are included within its scope as best defined by the appended claims.

What is claimed is:

1. A sheet feeder, comprising:

a plurality of different types of frictional feed members, the one type of feed member having a frictional characteristic enabling the one type of feed member to feed tags and the other type of feed member having a frictional characteristic enabling the other type of feed member to feed liner-backed pressure sensitive labels, a turret to bring the types of feed members selectively into position to feed either tags or liner-backed pressure sensitive labels, and a driver selectively coupled to one of the feed members to feed either tags or liner-backed pressure sensitive labels.

2. A sheet feeder as defined in claim 1, wherein one of the types feed members includes a feed roll, wherein the turret includes a pivotably mounted frame, the feed roll being rotatably mounted in the frame.

3. A sheet feeder as defined in claim 1, including a first conveyor;

a second conveyor for selectively receiving the tags or liner-backed pressure sensitive labels from the first conveyor, the second conveyor including the turret, the feed members comprising first and second rolls mounted on the turret, a third roll, at least one conveyor belt trained about the first, second and third rolls;

the driver including a rotatable drive shaft capable of being coupled to either the first roll or the second roll, the first roll being capable of feeding liner-backed pressure sensitive labels when the drive shaft is coupled to the first roll, and belts capable of feeding tags when the drive shaft is coupled to the second roll.

4. A sheet feeder as defined in claim 1, the driver including a drive shaft, a first sprocket on the drive shaft, a motor-driven second sprocket, and an endless drive chain drivingly connecting the first and second sprockets.

5. A sheet feeder as defined in claim 1, wherein the driver drives a first coupling member, a second coupling member for each of the feed members, and wherein the first coupling member can be selectively coupled to either one of the second coupling members.

6. A sheet feeder as defined in claim 1, including a stop for the tags or labels to enable the tags or labels to be accumulated in a stack.

7. A sheet feeder as defined in claim 1, including a stacker base, a stacker carriage on the stacker base, the driver capable of being selectively coupled to one of the feed members, the stacker being shiftable on the stacker base between a first position along a path and an offset second position disposed laterally of the path relative to the first position, and wherein the sheets are feed into the stacker carriage while in the first position comprise most of the sheets in the stack and the sheets that are fed onto the stacker carriage while the stacker carriage is in the second position comprise one or more separator sheets.

8. A sheet feeder as defined in claim 7, wherein the driver includes a drive shaft, a first sprocket on the drive shaft, a motor-driven second sprocket, and an endless drive chain drivingly connecting the first and second sprockets.

9. A sheet feeder as defined in claim 1, wherein the driver includes a drive shaft, a first coupling member, wherein the drive shaft drives the first coupling member, a second coupling member for each of the feed members, and wherein the first coupling member can be coupled selectively to either one of the second coupling members.

* * * * *